US005601040A

United States Patent [19]

McGill

[11] Patent Number: 5,601,040

[45] Date of Patent: Feb. 11, 1997

[54] LANDFILL LEACHATE, GAS AND CONDENSATE DISPOSAL SYSTEM

[76] Inventor: Eugene C. McGill, 2445 E. 156th North, Skiatook, Okla. 74070

[21] Appl. No.: 370,498

[22] Filed: Jan. 9, 1995

[51] Int. Cl.[6] ..... F23J 11/00

[52] U.S. Cl. ..... 110/345; 110/346; 110/238; 110/215

[58] Field of Search ..... 110/345, 346, 110/204, 211, 215, 238, 216; 588/228, 230

[56] References Cited

U.S. PATENT DOCUMENTS

| | | | |
|---|---|---|---|
| 3,543,701 | 1/1970 | Doner . | |
| 3,780,674 | 12/1973 | Liu . | |
| 3,881,430 | 5/1975 | Katz . | |
| 3,918,374 | 11/1975 | Yamamoto et al. . | |
| 3,941,065 | 3/1976 | Albrecht . | |
| 4,078,503 | 3/1978 | von Dreusche, Jr. | 110/208 |
| 4,213,407 | 7/1980 | Headley | 110/346 |
| 4,347,226 | 8/1982 | Audeh et al. | 423/207 |
| 4,475,466 | 10/1984 | Gravely | 110/238 |
| 4,579,069 | 4/1986 | Gay et al. | 110/342 |
| 4,598,650 | 7/1986 | Schneckenberger | 110/246 |
| 4,765,257 | 8/1988 | Abrishamian et al. | 110/342 |
| 4,838,184 | 6/1989 | Young et al. | 110/346 |
| 4,949,655 | 8/1990 | Greer et al. | 110/346 |
| 5,059,405 | 10/1991 | Watson et al. | 423/210 |
| 5,143,001 | 9/1992 | Eriksson | 110/345 |
| 5,484,279 | 1/1996 | Vonasek | 110/346 X |

*Primary Examiner*—Henry A. Bennett
*Assistant Examiner*—Susanne C. Tinker
*Attorney, Agent, or Firm*—Bill D. McCarthy; Phillip L. Free, Jr.; Randall K. McCarthy

[57] ABSTRACT

Disposal of land filled-produced leachate, gas and condensate, comprising combusting a first portion of a land filled-produced gas to produce hot flue gas, contacting the landfill-produced leachate and condensate with a portion of the hot flue gas to vaporize all of the leachate and condensate liquids to form a composite gas stream, and combusting the composite gas stream to convert any noxious components remaining therein to non-polluting compounds. Further, solids entrained in the composite gas stream can be separated from the composite gas stream. Following combustion of the composite gas stream, only non-polluting compounds are discharged to the atmosphere.

24 Claims, 4 Drawing Sheets

LANDFILL LEACHATE, GAS AND CONDENSATE DISPOSAL SYSTEM

BACKGROUND OF THE INVENTION

1. Field of Invention

The present invention relates to the field of pollution control, and more particularly but not by way of limitation, to process apparatuses and methods for the disposal of noxious landfill-produced leachate, gases and condensate.

2. Discussion

Various kinds of wastes are buried in landfills that are known to produce noxious gases and condensates as the wastes decompose. In addition, water from rain and other sources percolates through the buried wastes, creating noxious leachates. These leachates are composed of a variety of chemicals, many of which are hazardous. Escaping gases and liquids from such landfills are recognized as sources of pollutants that present health and environmental hazards and must be collected and treated.

It is common to dispose of the noxious gases produced by a landfill by withdrawing these largely methane-based gases and burning them in flares or other types of gas combustion devices. In most cases removal of the noxious gases from the landfill results in the production of liquid condensates. These condensate liquids together with the leachate liquids have traditionally been collected and hauled from the landfill site for disposal. This process of disposal is of itself regulated and expensive as evidenced by the large amount of attention that has been given to the transportation and safe disposal of industrial waste liquids.

Prior art technology has been developed to deal with leachate and condensate disposal and includes the destruction of the liquid leachate in a gas-fired, direct contact evaporator, such as that taught in the patent to Young et al., U.S. Pat. No. 4,838,184. The Young patent teaches an apparatus and method for combusting a portion of the landfill gases and contacting a stream of the hot combustion products with the leachate liquids from the landfill to vaporize a portion of the leachate liquids. The composite gas stream is thereafter combusted. The Young process produces some particulate in the final combustion products which are exhausted to the atmosphere from the stack; furthermore, concentrated leachate residue is collected in the accumulator, and must be withdrawn and transported to an off-site location for appropriate disposal.

It is also known to treat leachate liquids and gases produced from landfills by diverting a portion of the combustion products, or flue gas, into an evaporator to concentrate the leachate liquid. This method also suffers from the drawback that the concentrated leachate must be hauled away for disposal. Both this process and that taught by the Young patent involve the use of wet sump pumps which, among other difficulties, present severe corrosion problems and thus potential operational unreliability.

These methods of dealing with leachate and condensate liquids suffer from another common drawback as a result of concentrating the leachate liquid. The Toxicity Characteristic (TC) of a leachate liquid stream is an expression of the concentration of certain EPA (Environmental Protection Agency) listed chemical compounds, such as chlorinated organics and heavy metals, among others. Once prohibited concentrations of such compounds are reached, as determined by EPA's Toxicity Characteristic Leaching Procedures (TCLP), the leachate stream becomes a hazardous waste which requires special processing. Anytime the liquid leachate is subjected to a concentrating process such as in the Young patent, there is a possibility that the liquid leachate may become so concentrated as to exceed the range of acceptable TC levels, requiring hazardous waste treatment. Clearly, such hazardous waste designation is undesirable.

In the past, one other approach provided for the direct injection of the landfill-produced leachate into a combustor. However, direct injection of leachate and/or condensate liquid into a landfill gas combustor is unlawful without appropriate regulatory permits, as direct injection changes the landfill gas combustor to a liquid incinerator, and more rigorous regulations apply to incinerators. The increased regulations are in large part due to the extreme variability in the composition of landfill-produced leachate liquid streams. The composition of the leachate liquid streams depends upon many factors, such as leachate flows and strengths, landfill age, and other environmental influences. For instance, as a landfill ages, many complex, non-biodegradable compounds are produced, often including chlorinated organics and heavy metals, among others. Landfill gas combustors are only permitted to burn gaseous fuels because such compounds found in leachate liquids often produce environmentally hazardous discharges. Another reason that landfill-produced leachate and condensate liquids cannot be burned in a landfill gas combustor is that any solids contained in the landfill-produced leachate or condensate liquids are exhausted from the combustion stack with the flue gas, presenting a potentially hazardous discharge of heavy metals or particulates in violation of regulatory requirements.

The direct injection approach also presents the possibility of a leachate spill should an injector become fouled of damaged. As is known, typical combustion equipment used for the destructive combustion of pollutants generally utilize ceramic fibers in the flame chamber for thermal protection of the metal components. Leachate spills can potentially damage ceramic fibers and, therefore, ceramic fibers are not recommended for use in furnaces which process liquids.

It would be desirable to have a disposal system that would overcome these and other limitations of the prior art systems. That is, it is desirable to have a disposal system which can lawfully dispose of all leachate, gases and condensates produced from any landfill of any age in an apparatus which disposes of such landfill pollutants on-site while producing combustion products which can be readily discharged in compliance with air quality standard and regulatory permits governing landfill gas combustors.

SUMMARY OF THE INVENTION

The present invention provides for the disposal of landfill-produced leachate, gas and condensate, has broad composition and flow capabilities, and produces combustion products readily dischargeable in compliance with air quality standards and regulatory permits. Landfill-produced gas is combusted in a landfill gas combustor to produce hot flue gases. The landfill-produced leachate and condensate are then contacted with a portion Of the hot flue gases from the combustor to vaporize all of the leachate and condensate to form a composite gas stream. The composite gas stream is combusted in the landfill gas combustor to convert any noxious components remaining therein to non-polluting compounds.

In one embodiment, a particulate removal system is provided to remove particulates from the composite gas stream, as may be required before combusting the composite gas stream in the landfill gas combustor.

It is, therefore, a general object of the present invention to provide for the disposal of contaminated landfill-produced leachates and condensates without compromising the combustor operation, without producing emissions in violation of air quality standards or regulatory permits, and without risk of producing hazardous wastes.

A further object of the present invention, while achieving the above stated object, is to provide a leachate and condensate disposal system which can be installed as a complete system or which can retrofit existing landfill gas combustors.

Yet another object of the present invention, while achieving the above stated objects, is to provide apparatuses and methods for disposing of substantially all of the landfill-produced leachate and condensate without the need to remove leachate and condensate from the landfill site.

One further object, while achieving the above stated objects, is to provide apparatuses and methods for disposing of substantially all of the leachate and condensate while avoiding the possible production of hazardous wastes.

Other and further objects, features and advantages of the present invention will be readily apparent to those skilled in the art upon a reading of the description which follows when read in conjunction with the accompanying drawings and claims.

BRIEF DESCRIPTION OF THE DRAWINGS

FIG. 6 is a schematic of another disposal process apparatus constructed in accordance with the present invention.

DESCRIPTION

Figure 1:
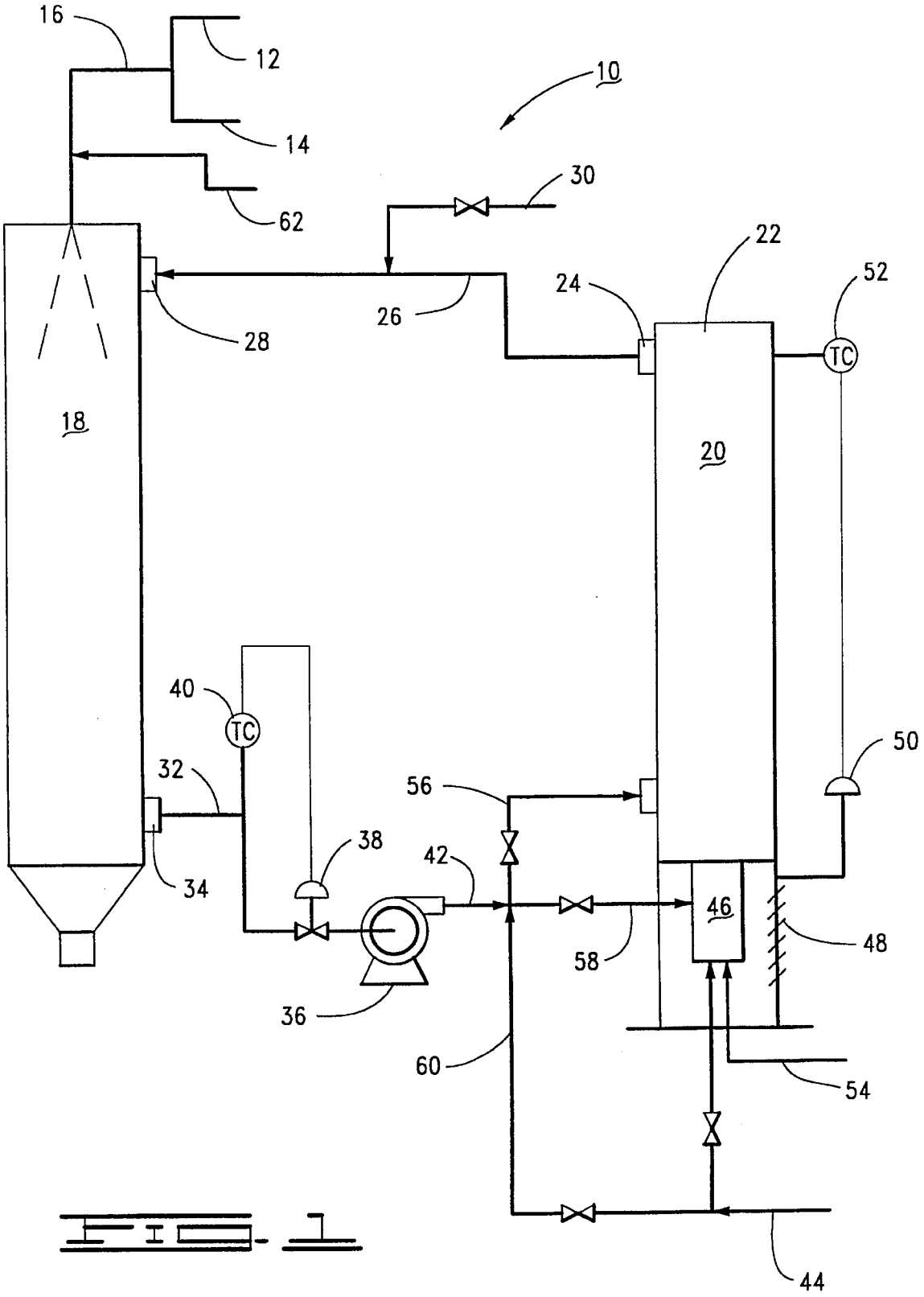
FIG. 1 is a schematic representation of a disposal process apparatus constructed in accordance with the present invention.

Referring now to FIG. 1 Of the drawings, illustrated is a schematic of a disposal process apparatus 10 constructed in accordance with the present invention. While the present invention will be described in detail hereinbelow, it will be appreciated that numerous details of construction involving the usual piping, valving, electrical systems and controls associated with process equipment of the type herein described will be known to periods skilled in this area of technology and need not be included herein. The same numbers will be used in FIGS. 1 through 7 where designating similar or identical components.

As a landfill ages, decomposition of the waste produces landfill gases and liquid leachates. If ignored the landfill gases will permeate the landfill and fugitive gaseous emissions are discharged into the atmosphere. Furthermore, the leachate liquids can find their way into ground waters. To avoid or at least minimize such deleterious effects, landfill operators have developed methods to collect and appropriately dispose of the landfill gases and leachates.

Collection of landfill gases and leachate liquids is accomplished by sinking collection wells at strategic locations in the landfill. Landfill gas is drawn from these wells by blowers or the like and passed to combustion equipment. The collected landfill gases are warm and saturated with moisture as withdrawn from the landfill wells, and as the gases cool, a liquid condensate stream is collected. Further, liquid leachate is collected by a leachate collection system disposed in the landfill. Both the liquid condensate stream and the liquid leachate from the landfill must be treated as well as the landfill gas which must be combusted.

In FIG. 1, the disposal process apparatus 10 has a conduit 12 which is connected to a source of landfill leachate and another conduit 14 which is connected to a source of landfill condensate. That is, the conduits 12, 14 are connected to apparatus (not shown) for collecting liquid leachate, liquid condensate and gas produced in a landfill. The conduits 12, 14 are coupled to an inlet conduit 16 that carries the mixture of leachate/condensate liquids.

The inlet conduit 16 is connected to a stand alone, direct contact evaporator 18. Although the present embodiment utilizes the evaporator 18, a spray chamber or a fluid bed would be an acceptable equivalent. Preferrably, the leachate/condensate liquid is atomized as it is introduced into the evaporator 18 by an injection means selected from various atomizing methods and devices that are well known. Also, the conduits 12 and 14 can be connected directly to the evaporator 18.

The disposal process apparatus 10 has a landfill gas combustor 20 which has a vertical stack 22. The landfill gas combustor 20, a modification of a conventional landfill combustor, has a recirculated flue gas outlet 24, and a conduit 26 is connected between the recirculated flue gas outlet 24 of the vertical stack 22 and a recirculated flue gas inlet 28 of the evaporator 18. The conduit 26 conducts hot flue gas, or combustion products, to the evaporator 18. A quench air conduit 30 connects to the conduit 26, and at start-up or shut-down, quench air supplied through the conduit 30 can be used to normalize the equipment in preparation for the introduction or cessation of the flow of the hot flue gases. Of course, there are other methods of preheating or cooling the equipment, so the present invention is not limited to any particular means of starting-up or shutting-down the equipment.

In the evaporator 18, the hot flue gas from the conduit 26 contacts the atomized leachate/condensate liquid from the inlet conduit 16. Water and volatile chemicals are evaporated; dissolved or suspended solids, if any, are dried to particulate form and are suspended in the composite gas stream produced in the evaporator 18. Over time, dry ash may collect in the bottom of the evaporator 18 and may occasionally need to be removed. However, it is important to note that the disposal process apparatus 10 does not produce a concentrated liquid which must be removed and treated or otherwise eliminated.

In FIG. 1, the evaporator 18 is depicted in a downflow orientation, but it will be understood that an upflow or horizontal design will accomplish equivalent results. The evaporator 18 provides mixing and time for the leachate/condensate liquid to evaporate and for the particulate to dry.

A conduit 32 is connected to a composite gas outlet 34 of the evaporator 18 and to a motive driver or fan 36 that pulls the composite gas stream (the leachate/condensate vapors and cooled flue gas) from the evaporator 18. A control valve 38 is disposed in the conduit 32 and is responsive to a temperature sensor 40 which is positioned to sense the temperature of the composite gas stream ducted from the evaporator 18. By modulating the control valve 38 or varying the speed of the fan 36, the temperature of the composite gas stream can be maintained at a desired set point. An alternative arrangement that would control the temperature of the system would be to fix the flow to the fan 36 and modulate the leachate/condensate flow through the inlet conduit 16 via an appropriate control valve (not shown). These and other control methods are well known to those skilled in combustion systems. Other motive drivers such as eductors could replace the fan 36 shown in FIG. 1.

The composite gas stream from the evaporator 18 is drawn by the fan 36 for passage to the landfill gas combustor 20 via a conduit 42. Only gases and vapors are burned in the landfill gas combustor 20. A conduit 44 is connected to a burner section 46 of the landfill gas combustor 20 and serves to supply landfill gas as the fuel source for the landfill gas combustor 20. Combustion air is provided to the burner section 46 via a louvered air damper 48. The combustion of the landfill gas is an exothermic reaction which usually requires quench air to maintain a set operating temperature. As the composite gas stream reaches the landfill gas combustor 20, the temperature in the stack 22 drops momentarily, and inlet air is regulated by modulating the air input through the air damper 48. This is automatically controlled by a temperature responsive controller 50 having a temperature sensor 52 connected to sense the temperature of the combustion products in the vertical stack 22; the temperature responsive controller, 50 is a conventional actuator that effects the opening or closing of the louvers of the air damper 48 to control the combustion air. Pilot fuel is supplied to the burner section 46 by a conduit 54, and auxiliary fuel may also be supplied by a conduit (not shown) if necessary.

The composite gas stream from the evaporator 18 can be injected into the landfill gas combustor 20 in a number of ways. Because the composite gas stream is a cooled, basically inert gas, staged injection around the burners in the burner section 46 can act to minimize $NO_x$ formation. The composite gas stream from the fan 36 via the conduit 42 can be split into two portions and passed via conduits 56 and 58 for staged injection, or all of the composite gas stream can be injected above the burner section 46 through the conduit 56. Further, an amount of landfill gas can be premixed with the composite gas stream in the conduit 42 via a conduit 60 to produce a lean fuel for post-ignition injection.

An existing landfill gas combustor can readily be converted or retrofitted to provide the landfill leachate, condensate and gas disposal system of the present invention. The system of the present invention can be provided as a total landfill leachate, condensate and gas disposal system and can be either portable or fix based.

In the operation of the disposal process apparatus 10 illustrated in FIG. 1, hot flue gas is extracted from the vertical stack 22 of the landfill gas combustor 20 and passed via the conduit 26 to the evaporator 18. The hot flue gas is contacted in the evaporator 18 with a spray of leachate/condensate droplets formed by atomizing air (or other atomizing fluid) through a conduit 62 as the leachate/condensate liquid is introduced into the evaporator 18 via the inlet conduit 16. The hot flue gas totally evaporates water and volatile chemicals of the leachate/condensate liquid and is cooled thereby.

Leachate/condensate liquid typically requires less than 40% of the total heat input for evaporation. Retention time increases when leachate/condensate liquid is processed because the vapor has a greater heat capacity than the quench air it replaces. Recirculating the hot flue gas and cooling it with the atomized leachate/condensate liquid converts the landfill gas combustor 20 to low $NO_x$ operation.

FIG. 2

Figure 2:
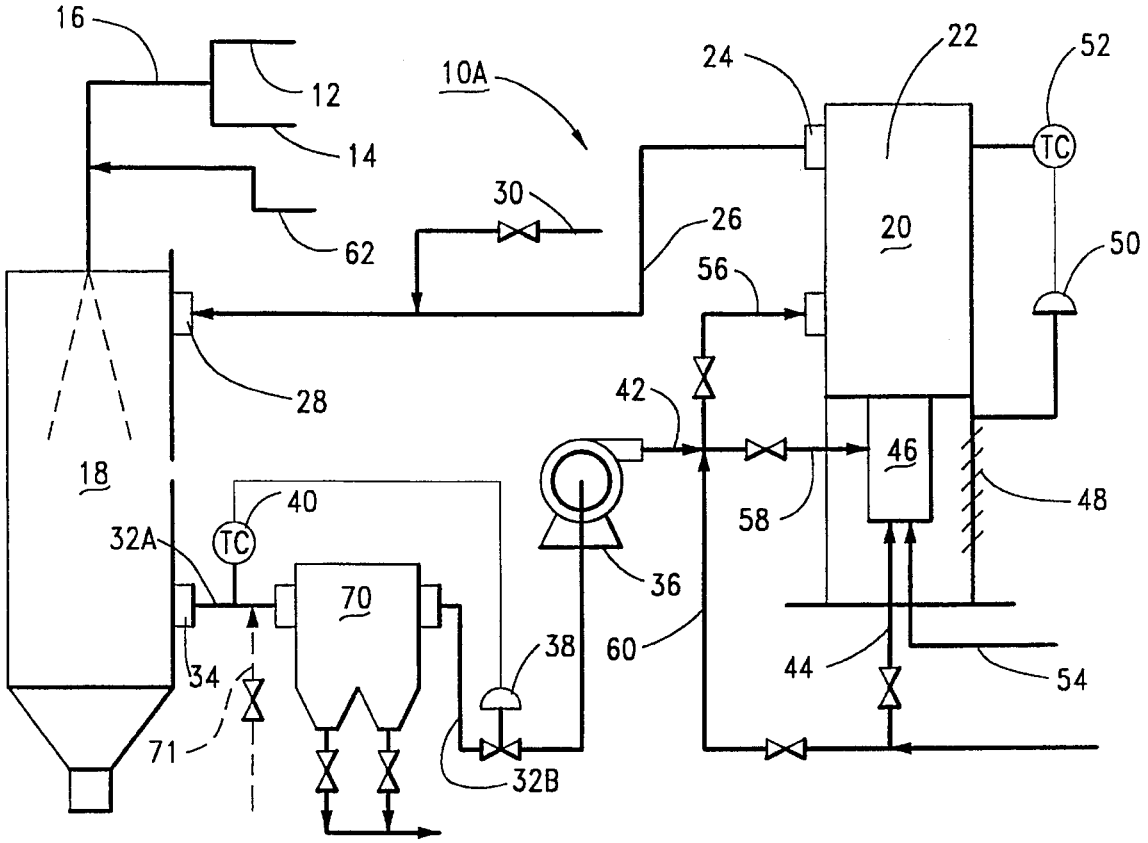
FIG. 2 is a schematic of another disposal process apparatus constructed in accordance with the present invention.

Turning now to FIG. 2, illustrated therein is a disposal process apparatus 10A which is identical in construction to the above described disposal process apparatus 10 with the exceptions noted. That is, the description for the disposal process apparatus 10A is the same as that for the disposal process apparatus 10 of FIG. 1, except that a conduit 32A connects the evaporator 18 to a dust or particulate collector 70. The particulate collector 70 can be any one of a number of commercially available recovery devices, such as an electrostatic precipitator, a filter, a cyclone separator or a bag house. There are advantages and disadvantages to each of these particulate collectors and the final selection is well within the engineering judgment of persons skilled in the art.

The particulate collector 70 removes and collects dry particulate matter from the composite gas stream; the collected particulate matter is dropped as a solid powder into hoppers (not shown) or other collector receptacles. Once removed, the particulate matter can be mixed with stabilizing material, such as cement, flyash or other inert substance, as may be necessary. The composite gas stream passes through the particulate collector 70 and is exhausted through a conduit 32B as drawn by the fan 36 for passing to the landfill gas combustor 20.

In the operation of the disposal process apparatus 10A, hot flue gas is extracted from the landfill gas combustor 20 at a point near the top of the vertical stack 22 and is ducted to the evaporator 18 via the conduit 26. The hot flue gas is contacted with a spray of leachate/condensate droplets formed by a stream of atomizing air (or other atomizing fluid) from the conduit 62 as the leachate condensate liquid is introduced into the evaporator 18 via the inlet conduit 16. The hot flue gas evaporates all of the water and volatile chemicals in the leachate/condensate liquid and is cooled thereby.

The temperature sensor 40, located to sense the temperature of the composite gas stream at the inlet to the particulate collector 70, controllably motivates the control valve 38, and the fan 36 draws the leachate/condensate vapors, cooled flue gas and entrained particulates (if any) through the conduit 32B from the particulate collector 70. The temperature of the composite gas stream entering the particulate collector 70 is preferably maintained at a selected temperature set point by either modulating the control valve 38 or varying the speed of the fan 36. The temperature set point of the system will be determined by the limitation of the selected particulate collector 70. For example, if an electrostatic precipitator is selected, the temperature set point range can be about 450° F. to 550° F., or higher. If a fabric filter is selected, the temperature set point range is limited to about 350° F. to 450° F. In some instances it may be desirable to adjust the temperature of the composite gas stream in the conduit 32A downstream to the temperature sensor 40 and prior to entry to the particulate collector 70, and an air conduit 71 is provided for this purpose. This feature serves as a fine adjustment means to protect the particulate collector 70 as may be required. This input of temperature adjusting air via the air conduit 71 can be manually or automatically controlled via methods known to persons skilled in the art. As discussed above, many types of recovery devices are available and the selection should not limit the application of the present invention.

FIG. 3

Figure 3:
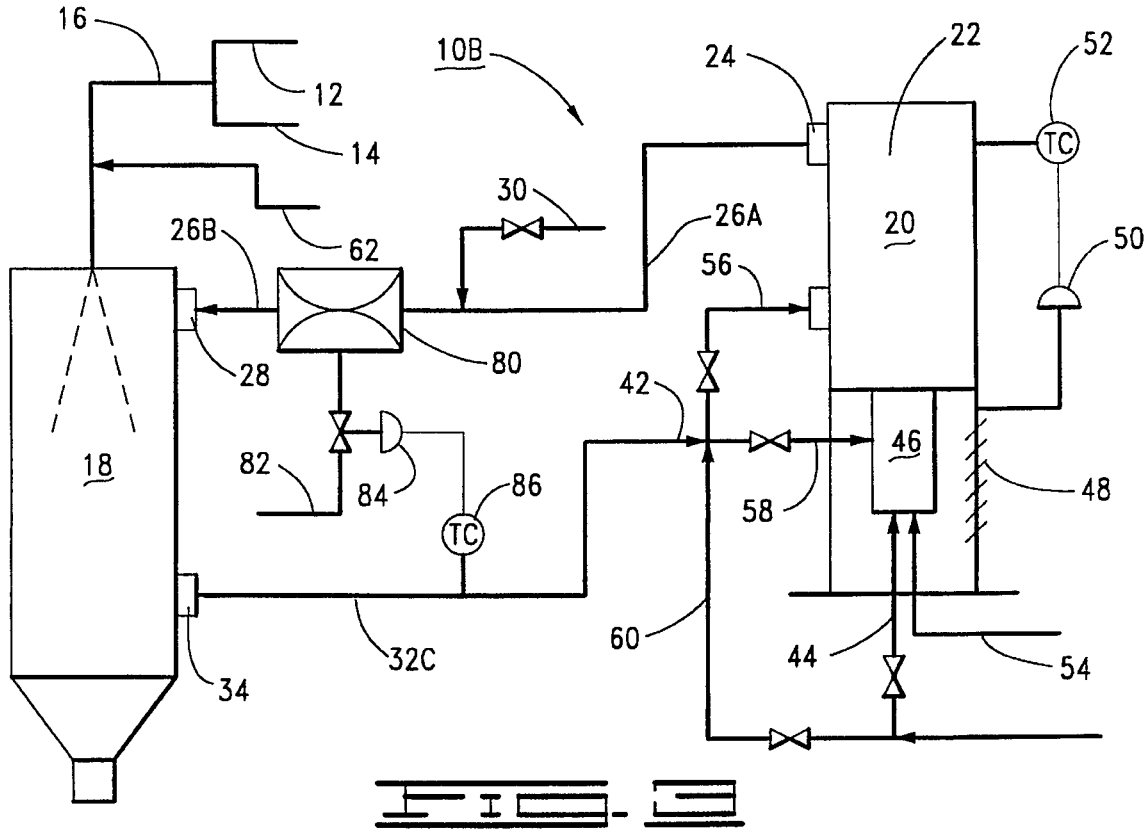
FIG. 3 is a schematic of yet another disposal process apparatus constructed in accordance with the present invention.

Turning now to FIG. 3, illustrated therein is a disposal process apparatus 10B constructed in accordance with the present invention. As discussed above for the disposal process apparatus 10 and incorporating many of the same components, the disposal process apparatus 10B comprises the evaporator 18 and the landfill gas combustor 20 interconnected as follows.

Conduit 26A is connected to the recirculated flue gas outlet 24 of the vertical stack 22 and to a motive driver or eductor 80 that draws the recirculated flue gas from the vertical stack 22. A conduit 82 is connected to the eductor 80 and provides a motive fluid, such as air or steam, to the eductor 80. A conduit 26B connects the eductor 80 to the recirculated flue gas inlet 28 of the evaporator 18. The eductor 80 provides motive force to drive the recirculated flue gas into the evaporator 18 and to drive the composite gas stream through the system.

A temperature responsive control valve 84 is disposed in the conduit 82, and a temperature sensor 86, connected to conduit 32C to sense the temperature of the composite gas stream from the evaporator 18, motivates the temperature responsive control valve 84. By modulating the temperature responsive control valve 84 in the conduit 82 that provides motive fluid to the eductor 80, the temperature of the system can be maintained at desired levels. An alternative arrangement would be to fix the flow to the eductor 80 and modulate the leachate/condensate flow. As discussed above, these and other control methods are well known to those experienced with combustion systems. Other motive drivers could replace the eductor 80 used in this illustration.

At start-up or shut-down, quench air supplied by the conduit 30 can be used to normalize the equipment in preparation for the introduction or cessation of flow of hot flue gas to the evaporator 18. Of course, there are other methods of preheating or cooling the equipment, so the present invention is not limited to any particular means of starting-up or shutting-down the equipment.

In the evaporator 18, hot flue gas contacts the atomized leachate/condensate liquid. Water and any volatile chemicals are evaporated and, any dissolved or suspended solids are dried to particulate form and suspended in the composite gas stream. Over time, dry ash may collect in the bottom of the evaporator 18, and the evaporator 18 may occasionally need to be cleaned. Appropriate valving or access port holes (neither shown) may be provided as desired. An important advantage of the present invention is that the disposal process apparatuses described herein do not produce a concentrated liquid bottom product which must be removed from the evaporator 18.

Conduit 32C is connected to the composite gas outlet 34 of the evaporator 18 for delivery of the composite gas stream to the landfill gas combustor 20. An important feature of the present invention is that only gases and vapors are burned in the landfill gas combustor 20. The conduit 44 supplies landfill gas as the source fuel to the landfill gas combustor 20. The combustion of landfill gas is an exothermic reaction which usually requires quench air to maintain a set operating temperature. As the composite gas stream conduit reaches the landfill gas combustor 20, the temperature in the stack drops momentarily, and the inlet air is regulated by modulating the air input. This is automatically controlled by the temperature responsive controller 50 that modulates the air damper 48.

In the operation of the disposal process apparatus 10B shown in FIG. 3, hot flue gas is extracted from the landfill gas combustor 20 near the top of the vertical stack 22, and is drawn through conduit 26A into the eductor 80 which delivers the hot flue gas to the evaporator 18 through conduit 26B. In the evaporator 18, the hot flue gas is contacted with a spray of leachate/condensate droplets introduced into the evaporator 18 through inlet conduit 16. The hot flue gas evaporates water and volatile chemicals in the leachate/condensate liquid and is cooled thereby. Any dissolved or suspended solid particulate is dried.

The temperature sensor 86 controllably motivates the control valve 84 in the conduit 82 to supply motive fluid to the eductor 80, which provides draws the recirculated hot flue gas from the landfill gas combustor 20 and drives the composite gas stream and any entrained particulate through the conduit 32C to the landfill gas combustor 20 for combustion therein.

FIG. 4

Figure 4:
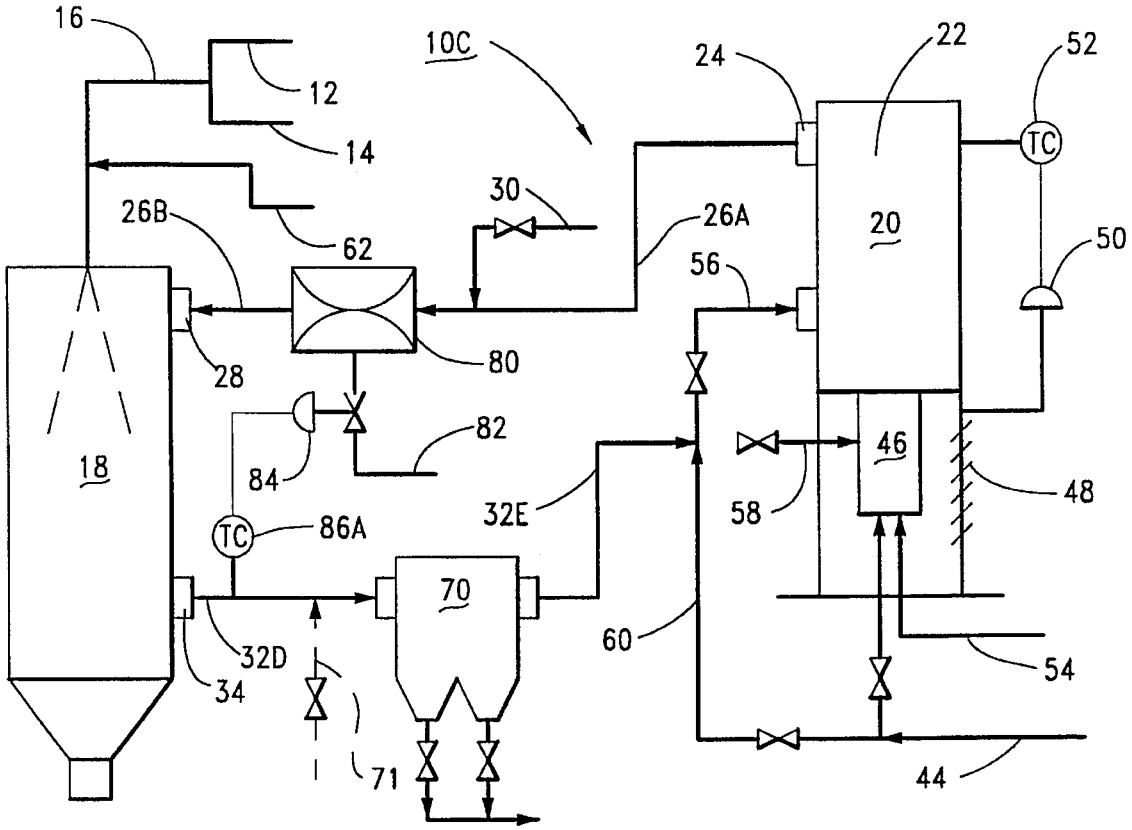
FIG. 4 is a schematic of one other disposal process apparatus constructed in accordance with the present invention.

Turning now to FIG. 4, shown therein is another embodiment of the present invention, a disposal process apparatus 10C which is identical in construction to that of the above described disposal process apparatus 10B with the exceptions noted. That is, the disposal process apparatus 10C also is similar to the disposal process apparatus 10A of FIG. 2 in that the particulate collector 70 is utilized. That is, in the disposal process apparatus 10C, a conduit 32D connects the evaporator 18 to the particulate collector 70. A conduit 32E connects the particulate collector 70 to the landfill gas combustor 20 as shown.

The conduit 26A is connected to the recirculated flue gas outlet 24 of the vertical stack 22 and to the eductor 80 that draws the recirculated flue gas from the vertical stack 22. The conduit 82 is connected to the eductor 80 and provides a motive fluid, such as air or steam, to the eductor 80. The conduit 26B connects the eductor 80 to the recirculated flue gas inlet 28 of the evaporator 18.

The temperature responsive control valve 84 is disposed in the conduit 82, and a temperature sensor 86A is connected to conduit 32D to sense the temperature of the composite gas stream from the evaporator 18 and to motivates the temperature responsive control valve 84. The temperature responsive control valve 84 in the conduit 82 provides motive fluid to the eductor 80, and the temperature of the system can be maintained at a desired level. As mentioned above, an alternative arrangement would be to fix the flow to the eductor 80 and modulate the leachate/condensate flow.

In the operation of the disposal process apparatus 10C shown in FIG. 4, hot flue gas is extracted from the landfill gas combustor 20 and is drawn through the conduit 26A into the eductor 80 Which delivers the hot flue gas to the evaporator 18 through the conduit 26B.

FIG. 5

Figure 5:
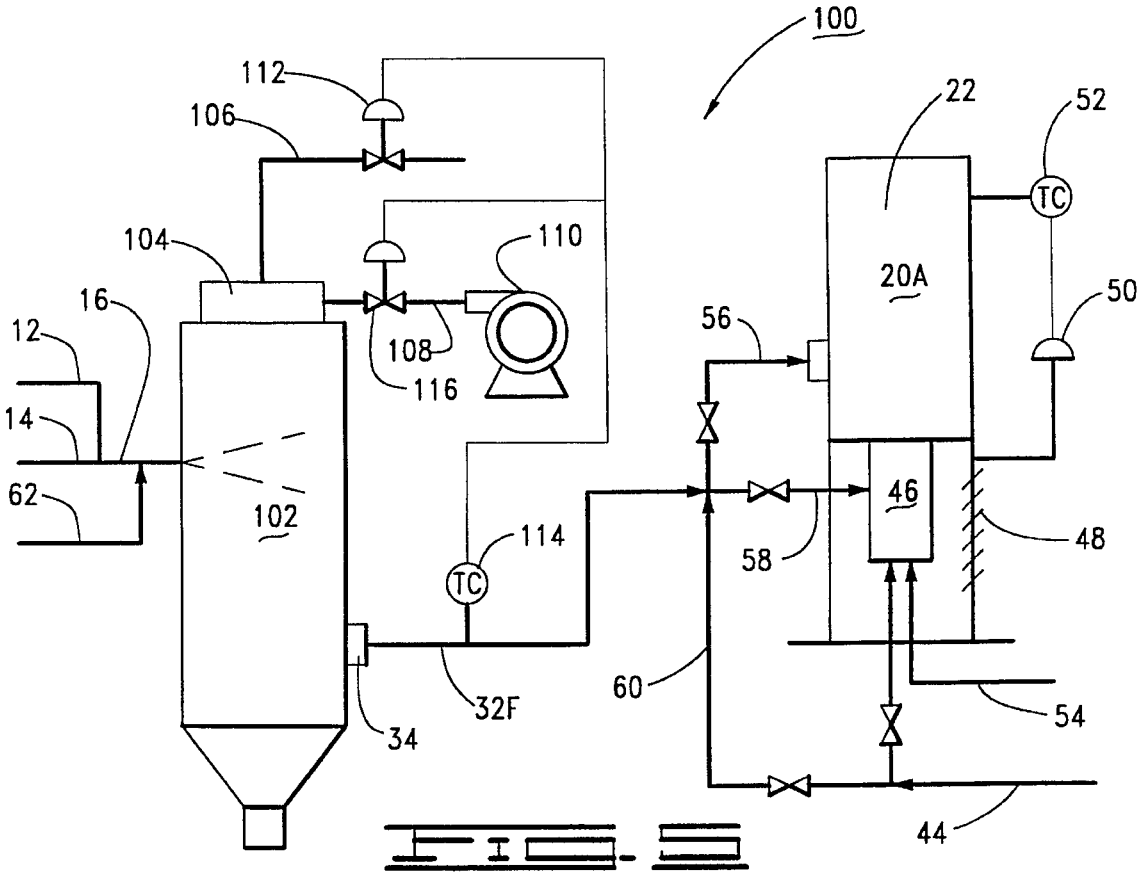
FIG. 5 is a schematic of one further disposal process apparatus constructed in accordance with the present invention.
Figure 5:
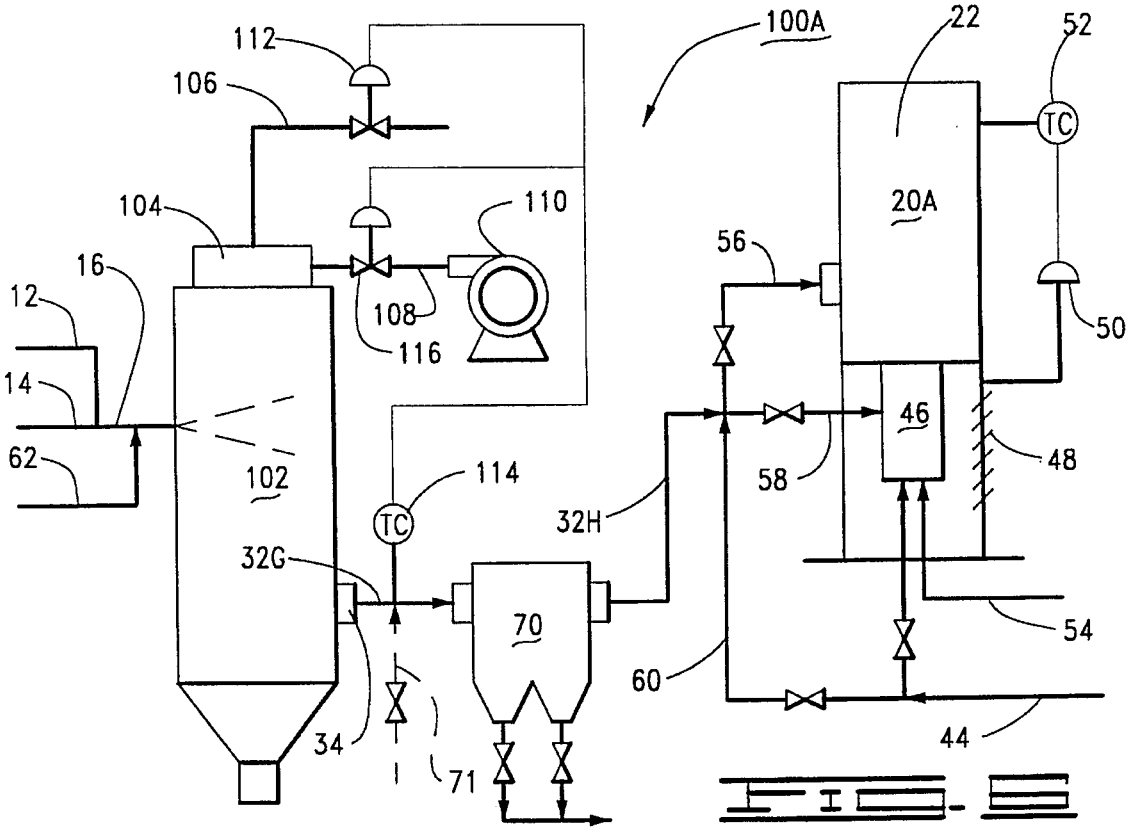

FIG. 5 illustrates another disposal process apparatus 100 constructed in accordance with the present invention. In FIG. 5, the disposal process apparatus 100 has an evaporator 102 that serves as a second combustor. That is, the evaporator 102 has a burner 104 at one end thereof, and the burner 104 serves to generate hot flue gas to the evaporator 102 by combusting landfill gas supplied by a conduit 106 using combustion air supplied by a conduit 108. A blower 110 is provides pressurized air to the conduit 108. Hot combustion products produced by the burner 104 enter the evaporator 102 and contact leachate/condensate liquid introduced into the evaporator 102 through the inlet conduit 16. Preferably, air from the conduit 62 atomizes the leachate/condensate liquid as it is introduced into the evaporator 102, as described above. All of the leachate/condensate is vaporized and dissolved or suspended solids are dried to particulate form. The composite gas stream is exhausted from the evaporator 102 through conduit 32F to a landfill gas combustor 20A as shown.

A temperature responsive control valve 112 is disposed in the conduit 106, and a temperature sensor 114 connected to the conduit 32F senses the temperature of the composite gas stream from the evaporator 102 and signals the temperature responsive control valve 112 to determine the flow of landfill gas to the burner 104. A similar temperature responsive control valve 116 is disposed in the conduit 108, and the temperature sensor 114 is also connected thereto. Thus, the two temperature responsive control valves 112 and 116 utilize a common temperature sensor. The temperature sensor 114 controls the control valves 112 and 116 in the conduits 106 and 108, respectively, for controlling the ratio of fuel to air supplied to the burner 104. By modulating the control valves 112 and 116, the temperature of the composite gas stream in the conduit 32F car be maintained. Alternatively, the rate of leachate/condensate liquid supplied to the evaporator 102 through inlet conduit 16 can be modulated. These and other ratio control systems are well known to those skilled in control systems, and all are considered to be acceptable substitutes and within the scope of the present invention.

It will be noted that the disposal process apparatus 100 does not recirculate any flue gas from the landfill gas combustor 20A for the purpose of evaporating any of the leachate/condensate as in the above described disposal process apparatus 10. Nevertheless, all of the leachate/condensate liquid is vaporized in the evaporator 102, and only gases and vapors pass therefrom to the landfill gas combustor 20A.

In the operation of the disposal process apparatus 100 shown in FIG. 5, landfill gas is provided through conduit 106 to the burner 104 where it is combusted in air supplied by conduit 108. The hot combustion products from the burner 104 enter the evaporator 102 and evaporate the leachate/condensate liquid introduced into the evaporator 102 through the inlet conduit 16.

The fuel and air supplied to the burner 104, supplied via the modulating of the a control valves 112 and 116 in the conduits 106 and 108, respectively. This maintains the temperature of the composite gas stream exiting the evaporator 102 through composite gas stream outlet 34 at a desired set point. The composite gas stream travels through conduit 32F to the landfill gas combustor 20A for combustion thereof, as described above. The landfill gas combustor 20A is identical in construction and operation to that of the landfill gas combustor 20 which has been described hereinabove except that the landfill gas combustor 20A does not have the recirculated flue gas outlet as there is no need for same since the disposal process apparatus 100 does not incorporate the recirculation of flue gas to the evaporator 102; rather, the evaporator 102 created its own flue gas via its burner 104 to evaporate the leachate/condensate liquids introduced to the evaporator 102 from the inlet conduit 16.

FIG. 6

Turning to FIG. 6, shown therein is another embodiment of the present invention, a disposal process apparatus 100A which is identical in construction to that of the above described disposal process apparatus 100 with the exceptions noted. That is, the disposal process apparatus 100A is the same as the disposal process apparatus 100 of FIG. 5, except that conduit 32G connects the evaporator 102 to the particulate collector 70, which is provided downstream of the evaporator 102. The composite gas stream exits the particulate collector 70 through a conduit 32H and is delivered to the landfill gas combustor 20A for combustion thereof, as described above.

In the operation of the disposal process apparatus 100A shown in FIG. 6, landfill gas is combusted in the burner 104 to provide a hot stream of flue gas to the evaporator 102 as in the other embodiments described above. The landfill gas and air mixture to the burner 104 are provided through conduits 106 and 108, respectively, and the temperature sensors 114 communicates with the control valves 112 and 116 to ratio control the fuel and air supplied to the burner 104, as described above, to maintain the temperature of the composite gas stream which exits the evaporator 102 at a selected temperature set point. Again, the temperature set point of the system will be determined by the limitations of the selected particulate collector 70 as described above.

FIG. 7

Figure 7:
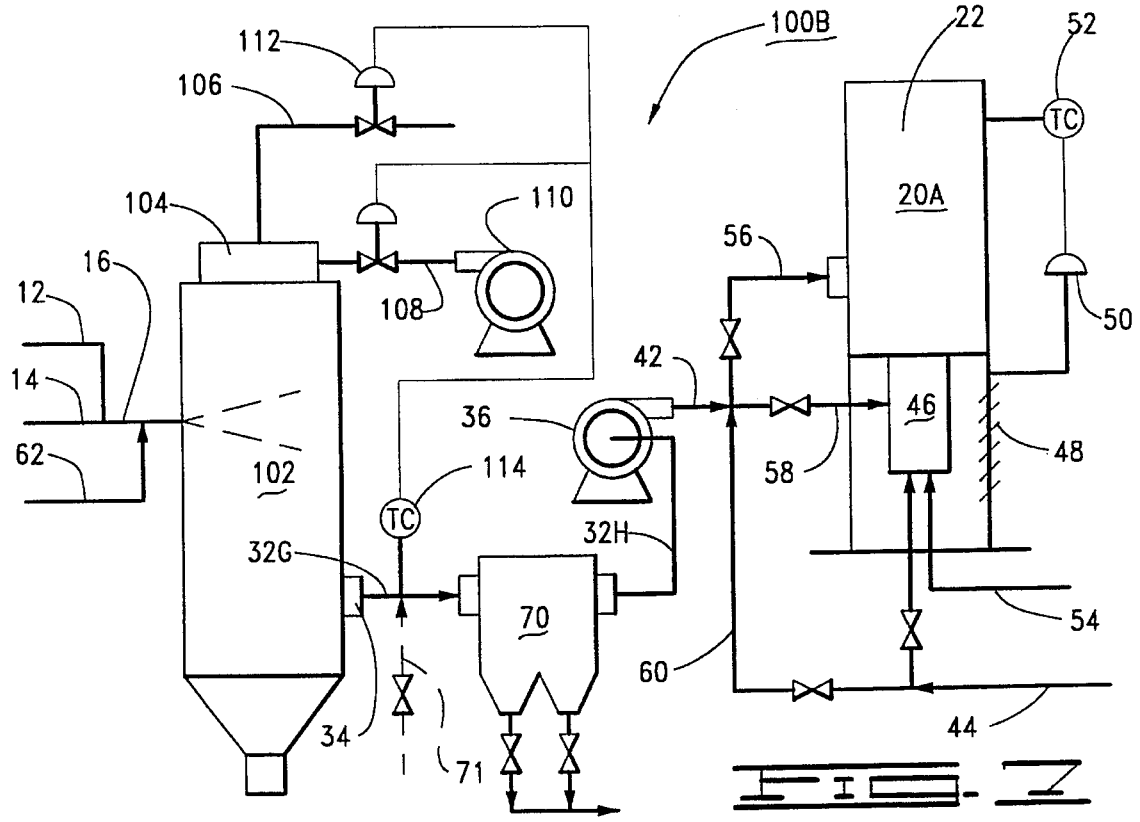
FIG. 7 is a schematic of one more disposal process apparatus constructed in accordance with the present invention.

Turning now to FIG. 7, depicted therein is a disposal process apparatus 100B, another embodiment of the present invention. The disposal process apparatus 100B is identical in construction to that of the above described disposal process apparatus 100A with the exceptions noted. That is, the disposal process apparatus 100B of FIG. 7 is the same as that illustrated in FIG. 6, except that a motive driver, the fan 36, is disposed downstream of the particulate collector 70 to pull the cleaned composite gas stream through the system. The fan 36 is connected to the outlet of the particulate collector 70 via conduit 32H, and the outlet of the fan 36 is connected to conduit 42 which is connected to the conduits 56 and 58.

The blower 110 in this embodiment is optional because the air supplied to the burner 104 via conduit 108 can be supplied under atmospheric or positive pressure. As described above, other motive drivers such as eductors could replace the fan 36 used in this illustration.

Thus, except for the inclusion of the fan 36 downstream of the particulate collector 70, the disposal process apparatus 100B is the same as that of the disposal process apparatus 100A described hereinabove. It will therefore be appreciated by persons skilled in the art that the operation of the disposal process apparatus 100B will be the same as that of the disposal process apparatus 100A with the exception that the pressure drops in the system will need to be adjusted to account for the additional pressure boost provided by the fan 36, and of course, should it be found to be desirable to omit the air blower 110, the appropriate adjustments must be made in the flows.

EXAMPLE

To illustrate the operation of the present invention, an example will be provided for the disposal process apparatus 10A depicted FIG. 2 described hereinabove. Conduit 44 supplies landfill gas at 4443.3 lbs/hr to the burner section 46 of the landfill gas combustor 20 which serves as the fuel source therefor. Pilot gas of 4.7 lbs/hr is also supplied to the burner section 46 via the conduit 54. Inlet air is supplied at a rate of 43181.01 lbs/hr through the air damper 48, and the temperature responsive controller 50, responsive to the temperature in the vertical stack 22 via the temperature sensor 52, modulates the air damper 48 so that the temperature of the flue gas is about 1800° F.

The flue gas exhausted from the stack 22 is 49129.01 lbs/hr, while 4464.85 lbs/hr of recirculated flue gas is withdrawn from the stack 22 through the recirculated flue gas outlet 24. The recirculated flue gas travels via conduit 26 to the recirculated flue gas inlet 28 of the evaporator. There the hot flue gas is contacted by a spray of 1028 lbs./hr. leachate/condensate liquid from the inlet conduit 16 and 500 lbs./hr. of atomizing air from the conduit 60.

The temperature set point of the system is maintained at 500° F. by the temperature sensor 40 disposed to sense the temperature of the composite gas stream at the inlet to the particulate collector 70. The particulate collector 70, for the present example, separates particulate matter from the composite gas stream at a rate of about 28.8 lbs./hr. The cleaned composite gas stream is drawn from the particulate collector 70. The fan 36 drives the composite gas stream which is split into portions via conduits 56 and 58 for staged injection into the landfill gas combustor 20.

The total recovery from the landfill, in the form of the leachate/condensate liquid and landfill gas, is converted into an acceptably dischargeable effluent by the disposal process apparatus 10A, as the total effluent discharged from the landfill gas combustor 20 is flue gas of the normal character of a landfill combustor. Further, all of the noxious components of the offput from the landfill has been adequately discharged on site without resort to offsite disposal of any kind, and no concentrating of the leachate/liquids has occurred, thereby avoiding possible regulatory impediments to the use of relative simple combustion equipment of the kind in normal use for non-noxious substances.

It is clear from the above descriptions and the example provided that the present invention is well adapted to carry out the objects and to attain the ends and advantages mentioned as well as those inherent therein. While presently preferred embodiments have been described for the purposes of this disclosure, it will be appreciated that numerous changes in the arrangement of method steps and apparatus components can be made by those skilled in the art. Such changes are encompassed within the spirit of this invention as defined by the appended claims.

What is claimed is:

1. A method for disposing of landfill leachate, gas and condensate, the method comprising:

combusting a first portion of landfill gas to produce hot flue gas;

contacting the landfill leachate and condensate with the hot flue gas to vaporize all of the leachate and condensate to form a composite gas stream; and combusting the composite gas stream to convert noxious components remaining therein to non-polluting compounds.

2. The method of claim 1 further comprising the step of:

separating particulate matter entrained in the composite gas stream prior to the step of combusting the composite gas stream.

3. The method of claim 2 wherein the first portion of landfill gas is combusted in a first combustor, a second portion of landfill-produced gas is combusted in a second combustor, and the composite gas stream is combusted in the second combustor.

4. The method of claim 3 wherein the first combustor is an evaporator having a burner in flue gas communication therewith.

5. The method of claim 3 wherein the second combustor is a landfill combustor.

6. The method of claim 3 further comprising the step of:

venting the non-polluting compounds to the atmosphere after the step of combusting the composite gas stream.

7. The method of claim 6 further comprising the step of:

stabilizing the separated particulate matter from the composite gas stream for final disposal.

8. A method for disposing of landfill leachate, gas and condensate, the method comprising:

combusting landfill gases in a landfill gas combustor to produce hot flue gases;

extracting a portion of the hot flue gases produced by the landfill gas combustor;

contacting the landfill leachate and condensate with the extracted portion of the hot flue gases to vaporize all of the leachate and condensate to form a composite gas stream; and combusting the composite gas stream in the landfill gas combustor to convert noxious components remaining therein to non-polluting compounds.

9. The method of claim 8 further comprising the step of:

venting the non-polluting compounds gas to the atmosphere.

10. The method of claim 9 further comprising the step of:

separating particulate matter entrained in the composite gas stream prior to the step of combusting the composite gas stream.

11. The method of claim 10 further comprising the step of:

stabilizing the separated particulate matter separated from the composite gas stream for final disposal.

12. An apparatus for disposing of landfill leachate, gas and condensate, the apparatus comprising:

combustion means for combusting the landfill gas, the combustion means comprising a landfill combustor having a composite gas stream inlet and a recirculated flue gas outlet;

first conduit means;

vaporizing means for vaporizing all of the landfill leachate and condensate by contacting the landfill leachate and condensate with recirculated flue gas to form a composite, gas stream, the vaporizing means having a recirculated flue gas inlet connected to the first conduit means, and a composite gas stream outlet; and second conduit means, connected to the composite gas stream outlet of the vaporizing means and to the composite gas stream inlet of the combustion means, for passing the composite gas stream from the vaporizing means to the combustion means for combustion thereof.

13. The apparatus of claim 12 further comprising:

motive driver means for providing motive force to the composite gas stream.

14. The apparatus of claim 13 further comprising:

temperature control means for controlling the temperature of the system.

15. The apparatus of claim 14 further comprising:

particulate recovery means connected to the second conduit means for separating and recovering particulate matter from the composite gas stream prior to combustion of the composite gas stream in the combustion means.

16. The apparatus of claim 15 wherein the vaporizing means further comprises:

atomizing means for atomizing the leachate and condensate prior to contact with the recirculated flue gas.

17. The apparatus of claim 16 wherein the vaporizing means further comprises:

quench air means for injecting quench air into the vaporizing means.

18. The apparatus of claim 17 wherein the combustion means further comprises:

a first combustor;

a second combustor; and wherein the landfill gas is combusted in the first combustor, and wherein the composite gas is combusted in the second combustor.

19. The apparatus of claim 14 wherein the vaporizing means comprises a spray dryer evaporator and wherein the motive driver means comprises a fan.

20. The apparatus of claim 14 wherein the motive driver means comprises an eductor.

21. An apparatus for disposing of landfill leachate, gas and condensate, the apparatus comprising:

burner means for producing a stream of hot combustion products;

vaporizing means for evaporating all of the leachate and condensate by contacting the stream of hot combustion products with the leachate and condensate with the stream of hot combustion products; and combustion means for combusting the landfill gas and the composite gas stream.

22. The apparatus of claim 21 further comprising:

particulate collector means for recovering particulate from the composite gas stream prior to combusting the composite gas stream.

23. The apparatus of claim 22 further comprising:

motive driver means for providing motive force to the composite gas stream.

24. The apparatus of claim 23 further comprising:

temperature control means for controlling the temperature of the system.

* * * * *

UNITED STATES PATENT AND TRADEMARK OFFICE

CERTIFICATE OF CORRECTION

PATENT NO. : 5,601,040
DATED : February 11, 1997
INVENTOR(S) : Eugene C. McGill

It is certified that error appears in the above-indentified patent and that said Letters Patent is hereby corrected as shown below:

Cover page, line 1 under the word "ABSTRACT", delete the words "land filled-produced", and insert --landfill-produced--.

Cover page, lines 2 and 3 under the word "ABSTRACT", delete the words "land filled-produced" and insert --landfill-produced--.

Column 8, line 12, after the word "which" and before the word "draw", delete the word "provides".

Column 8, lines 59 and 60, after the numeral "110" and before the word "provides" delete the word "is".

Column 2, line 33, delete the last word of the line "of", and insert --or--.

Column 2, line 60, delete "Of" and insert --of--.

Column 3, line 54, delete "Of" and insert --of-- therefor.

Column 3, line 61, delete the word "periods" and insert --persons--.

UNITED STATES PATENT AND TRADEMARK OFFICE

CERTIFICATE OF CORRECTION

PATENT NO. : 5,601,040

DATED : February 11, 1997

INVENTOR(S) : Eugene C. McGill

It is certified that error appears in the above-indentified patent and that said Letters Patent is hereby corrected as shown below:

Column 5, line 33, after the word "controller", delete the comma ",".

Column 8, line 49, delete "Which" and insert --which--.

Column 9, line 18, delete the word "car" and insert --can--.

Signed and Sealed this

Twenty-first Day of October 1997

*Attest:*

*Attesting Officer*

BRUCE LEHMAN

*Commissioner of Patents and Trademarks*